US005295588A

United States Patent [19]

Neirinckx

[11] Patent Number: 5,295,588

[45] Date of Patent: Mar. 22, 1994

[54] DISPLAY RACK FOR CAPS

[76] Inventor: Thomas R. Neirinckx, 1504 Willow La., Mount Prospect, Ill. 60056

[21] Appl. No.: 36,960

[22] Filed: Mar. 25, 1993

[51] Int. Cl.[5] ..... A47G 25/10

[52] U.S. Cl. ..... 211/32; 211/30

[58] Field of Search ..... D6/320; 211/30, 32, 211/33, 59.1, 44; 206/8, 9; 242/134, 139

[56] References Cited

U.S. PATENT DOCUMENTS

| | | | |
|---|---|---|---|
| D. 291,154 | 8/1987 | Owen | D6/320 X |
| 2,006,033 | 6/1935 | Sharpe | 211/30 X |
| 2,213,677 | 9/1940 | Miller | 211/30 |
| 2,246,692 | 6/1941 | Ohme | 211/59.1 |
| 2,940,685 | 6/1960 | Glass | 242/139 |
| 3,297,276 | 1/1967 | Skufca | 211/59.1 X |
| 3,506,215 | 4/1970 | Krikorian | 242/134 |
| 5,002,190 | 3/1991 | Moreland | 211/32 |

*Primary Examiner*—Blair M. Johnson
*Attorney, Agent, or Firm*—Robert J. Black

[57] ABSTRACT

A display type rack for mounting a number of baseball or sport-type caps in such a manner to display any frontal ornamentation appearing on the cap while supporting the cap in a conventional position effectively at right angles to a supporting wall or similar structure. The rack is expandable and may consist of two or more horizontal bases each equipped with cap body supporting pairs of vertical members and horizontal visor support members perpendicular to the vertical members. A number of base units equipped with horizontal and vertical support members may be assembled together and held in place by associated vertical supports.

7 Claims, 1 Drawing Sheet

DISPLAY RACK FOR CAPS

BACKGROUND OF THE INVENTION

1. Field of the Invention

The present invention relates to display racks, and more particularly to a rack adapted for storing and displaying caps.

2. Background Art

Current mania exists for the sale, distribution, wearing and collection of baseball or sport-type caps of a well-known type, including a dome-shaped body portion and a forward projecting visor or bill. Such caps displaying logos of sports teams, companies, organizations, etc., are readily available either through retail stores or distributed gratis for promotional, commemorative or similar reasons.

As a result of the foregoing, many individuals have accumulated numerous such caps. For anyone with a desire to display such caps, the availability of appropriate hat racks appears to be extremely limited.

A few racks are available commercially which display a limited number of caps in vertical orientation which display the caps in a slightly level obscuring mode and also cause some crushing of the cap itself, limiting the visibility of the cap. Such a unit is disclosed in U.S. design Pat. No. 324,960.

A search of the records of the U.S. Patent and Trademark Office discovered certain other patents which have been considered in connection with the filing of this patent application. These include:

U.S. Pat. No. 2,213,677
U.S. Pat. No. 4,583,646
U.S. Pat. No. 5,002,190
U.S. Pat. No. 5,038,941
U.S. Pat. No. 5,137,157
U.S. Pat. Des. No. 251,223
U.S. Pat. Des. No. 326,366

Most of the designs covered by the aforementioned patents suffer from the lack of ability to display a substantial number of caps as might be found in a typical collection, as well as obscuring or detracting from the position and shape of the caps and the designs included thereon. Accordingly, it is the object of the present invention to provide a new and improved display type hat rack for displaying sport or baseball type caps while overcoming the disadvantages found in the prior art.

SUMMARY OF THE INVENTION

The present invention in its simplest form includes at least two horizontal strip-like members each with a number of pairs of vertical members extending upward from the horizontal member. Each pair of vertical members are positioned apart an appropriate distance whereby the head or dome portion of the cap may rest its diameter across the vertical members. Also included, projecting from the front of the horizontal member in a plane perpendicular to that of the vertical members in a forward direction, is one or more horizontal members positioned between the pair of vertical members. Such horizontal member(s) effectively provides support for the visor or bill portion of a cap.

Appropriate spacing is also provided between adjacent pairs of vertical upright members so as to fully allow the placement of caps on the vertical members of one pair, while not interfering with any cap placed on an adjacent pair of members. This space is particularly critical and while it must allow space for caps to be placed on adjacent pairs, it should not be so far apart as to waste space causing the supporting rack to be excessively large.

Obviously from the foregoing, the horizontal element may be made as large as required, facilitating the inclusion of a large number of pairs of upright members allowing the placement, depending upon the number of pairs of upright members, from anything from two to any substantially greater number of caps on the horizontal assembly.

It is further envisioned, a number of horizontal units equipped with the vertical and horizontal members as described above may be joined together in a vertical manner by means of vertical support means connecting two or more of said units in a vertical direction perpendicular to the position of the horizontal elements with adequate spacing between said horizontal elements so as to facilitate the insertion, display, and removal of caps. Again, the number of horizontal elements is only going to be limited by available space, where, for example, as many as eight or ten might be included if it was desired to literally place the rack on an entire wall.

Two or more of the horizontal sections or the vertical support members may be attached to a supporting means, such as a wall or post by means of conventional fastening means, such as nails, screws, bolts, adhesive means, etc. Accordingly, it is the object of the present invention to provide a new and improved hat rack which may be readily adapted to different sizes and exhibits a substantial ease and economy of manufacture and installation and utilization.

DETAILED DESCRIPTION OF THE PREFERRED EMBODIMENTS

Figure 1:
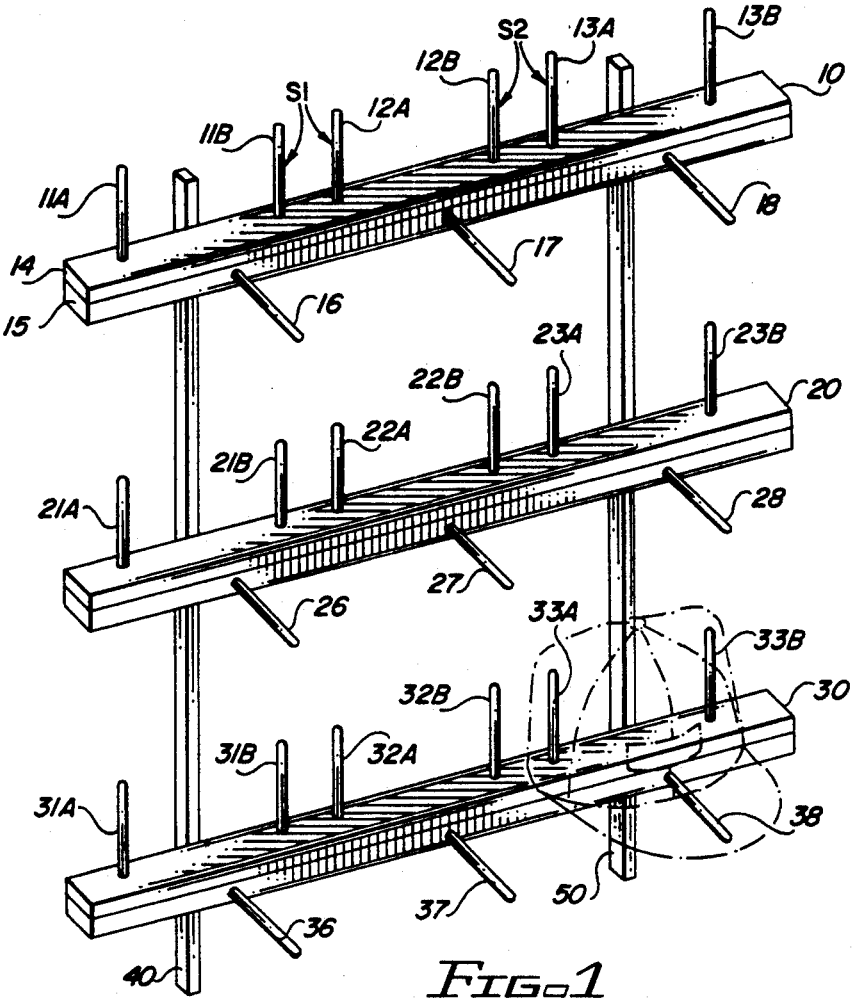
FIG. 1 is a perspective view of a display rack for sport caps and the like in accordance with the present invention, showing in phantom a baseball or sport-type cap positioned thereon.
Figure 2:
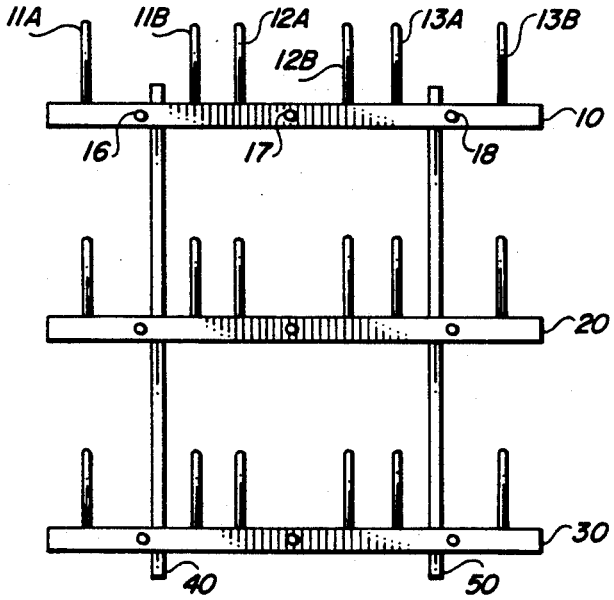
FIG. 2 is a front elevation of the rack in accordance with the present invention.

Referring now to FIG. 1 of the drawings of the application, a perspective view is shown of a display cap rack in accordance with the present invention, adapted to facilitate the support and display of nine baseball or sport-type caps. It should be understood that while the quantity of nine has been shown in the present embodiment, it will be obvious that units adapted for as few as four caps and an infinitely larger number could be produced employing the techniques described herein.

The display rack consists of three horizontal elements 10, 20 and 30. Projecting in an upward direction are pairs of vertical members, such as dowels, rods, pins, etc., situated in pairs. The first pair on horizontal element 10 consists of vertical members 11A and 11B, the second pair 12A and 12B and the third pair 13A and 13B. Similar pairs are also shown on horizontal elements 20 and 30. All of these vertical members are placed near the front edge of the horizontal element as may be readily seen by reference to FIG. 3. A minimum predetermined space between adjacent pairs, designated S1 or S2 is shown, for example, between vertical members 11B and 12A, and 12B and 13A. This critical spacing between adjacent pairs of vertical members readily facilitates the placement of caps thereon and caps in adjacent locations so as to provide economical usage of space while not interfering with caps in adjacent positions. Extending from the horizontal member in a location between each vertical pair is a horizontal support member, for example, on element 10 horizontal support members are 16, located between upright members 11A and 11B, 17 located between upright members 12A and 12B, and 18 located between upright members 13A and 13B. Obviously, single members have been shown but it is possible that plural members might be utilized which would accomplish a similar support function. Reference to horizontal elements 20 and 30 show similar configurations attached thereto of both vertical pairs of members and horizontal members arranged in the same manner as shown in FIG. 1 and associated with horizontal element 10. It should be noted that elements 16, 17 and 18, associated with horizontal element 10, are secured to element 10 front surface thereof.

As may be seen in FIG. 1, vertical elements 10, 20 and 30 may be divided into upper and lower sections, with the upper and lower sections of element 10 being identified as upper section 14 and lower section 15. Accordingly, the vertical pairs of members would be affixed to upper portion 14 while the horizontal lower projecting elements 16, 17 and 18 would be attached to the lower portion 15. A similar arrangement would also be present in connection with horizontal units 20 and 30. The reason for the possible utilization of upper and lower portions to each of the horizontal base units will be discussed hereinafter.

Joining horizontal base elements 10, 20 and 30 are support elements 40 and 50. These items are secured to each of the horizontal base elements and provide proper spacing between the elements for appropriate placement of caps thereon as well as providing possible means for securing the entire cap rack to a vertical surface, such as a wall or post or similar element. The particular technique for attaching the support elements to adjacent wall, etc., could be any well-known means, such as nails, screws, picture wire, or any similar hardware. Particular means for supporting the rack do not form a portion of the present invention.

Figure 3:
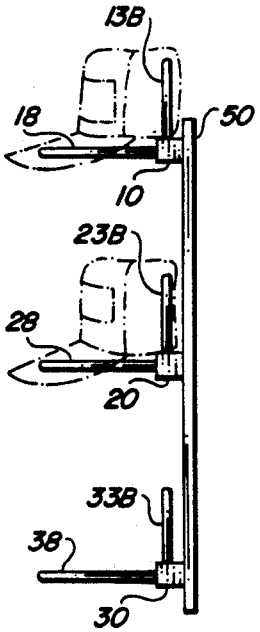
FIG. 3 is a side elevation of a rack in accordance with the present invention, also showing in phantom a cap thereon.

Typical placement of the cap is shown in phantom in both FIG. 1 and FIG. 3.

From the foregoing, it will be obvious that the simplest form of the cap rack of the present invention consists of two horizontal elements, such as 10, and 20 each equipped with only two pairs of vertical upright elements and two horizontal perpendicular elements, while more complex arrangements utilizing much longer horizontal elements, such as 10, 20 or 30 to accommodate a greater number of combinations of vertical pairs of elements and horizontal visor support elements, would also be possible, as well as a substantially increased number of horizontal elements, such as 10, 20 and 30, with the particular placement in a room against a wall, etc., being the only limiting factor as far as size is concerned. The present design is adapted to handle any number of caps from two to a much larger number depending upon the needs of the user. A collector may require one size, commercial operations who might be selling such caps might require even larger units.

In its simplest form, the rack of the present invention can be constructed of wood, utilizing board-like elements for horizontal bases 10, 20 and 30, with dowels being utilized for the vertical pairs, such as 11A and 11B, associated with base 10, and a similar dowel being used for the horizontal visor support element, such as 16. The support units may be strips of wood, or alternately could be means of other dowels drilled in holes or openings through the base elements.

It will be obvious to those skilled in the art that manufacture of such devices could also be made of plastic, metal, coated wire and any combinations of the above-identified materials. It could also be possible to have molded units that consist of, for example, the upper portion 14 of a support element, such as 10, with the pairs of vertical elements, such as 11A, 11B, 12A, 12B, 13A, and 13B directly molded thereto, while the lower portion 15 of base element 10 could be molded to include horizontal visor support elements 16, 17 and 18. After the completion of the molding, the two units 14 and 15 could then be joined by means of adhesive, heat welding, mechanical fasteners or some other means to form them into a unitary structure. It may be also possible to market the cap rack in accordance with the above described invention in kit form. The user could purchase base elements of the appropriate size and quantities as required, and also the appropriate number of elements to be used for the upright pairs as well as the horizontal visor support. Vertical support elements could also be supplied in different sizes depending upon the needs and requirements of the user. By this means, the individual user could customize a cap rack in accordance with the present invention to meet his particular needs or requirements.

The means for securing the vertical upright elements to be the base units might be by means of merely drilling holes for appropriate sized dowels, with similar techniques being employed for the visor support elements. It might also be possible, as indicated above, for them to be molded into the base elements as part of a unitary structure or they might be secured thereto by means of cement or some other mechanical means, the technique of which do not form a portion of the present invention, it only being required that the fastening of the vertical and horizontal support elements to the base be secure enough to support the light weight of the typical baseball or sport-type cap.

While but a single embodiment of the present invention has been shown, it will be obvious to those skilled in the art that numerous modifications may be made without departing from the spirit of the present invention, which shall be limited only by the scope of the claims appended hereto.

What is claimed is:

1. A cap rack in combination with and for supporting and displaying caps of the type having a body and a bill, said rack comprising:

at least two cap supporting sections each including;

a horizontally positioned linear base unit;

at least two pairs of spaced apart vertical members extending upward from said base unit positioned toward a front edge of said horizontally positioned linear base unit and having upper free ends;

said vertical members in each of said pairs spaced apart a predetermined distance to facilitate placement of the body of the cap over said members to support said body of said cap, with said pairs of vertical members spaced apart a predetermined distance to facilitate placement of the bodies of caps over each of said pair of members whereby said caps may be positioned adjacent to each other;

said vertical members each extending upward a predetermined distance to facilitate placement of the body of the cap over said members while maintaining said body of said cap in both horizontal and upright positions;

at least one horizontal member having a free end and extending forward from said base unit at a right angle to each of said vertical member pairs to facilitate the support of the bill of a cap on said horizontal support member;

vertical support means supporting said cap support sections a predetermined distance apart from each other; and means for securing said rack in an upright position.

2. A cap rack as claimed in claim 1 wherein:

said means for securing said rack in an upright position include means for attaching said means to a vertical structure.

3. A cap rack as claimed in claim 1 wherein:

said cap support sections each comprise a first linear horizontal segment;

at least two pairs of spaced apart vertical members extending upward from said first linear horizontal segment, a second linear horizontal segment including at least two horizontal members extending forward from said second horizontal segment at a right angle;

said first and second horizontal segments secured together to form a horizontally positioned linear base unit.

4. A cap rack as claimed in claim 1 wherein:

said horizontally positioned base units, said vertical members, said horizontal members and said vertical support means comprise a kit adapted to be assembled into said cap rack.

5. A cap rack as claimed in claim 1 wherein:

said horizontal base units, said vertical members and said horizontal member are all constructed of wood.

6. A cap rack as claimed in claim 1 wherein:

said horizontal base units, said vertical members and said horizontal member are all constructed of plastic.

7. A cap rack as claimed in claim 1 wherein:

said horizontal base units, said vertical members and said horizontal member are all constructed of metal.

* * * * *